United States Patent [19]

Marchese, Jr.

[11] Patent Number: 4,911,452

[45] Date of Patent: Mar. 27, 1990

[54] METHOD OF PLAYING A CATEGORY GAME

[76] Inventor: Alfred J. Marchese, Jr., 11 Minnehaha Blvd., Oakland, N.J. 07436-2803

[21] Appl. No.: 181,170

[22] Filed: Apr. 13, 1988

[51] Int. Cl.[4] ..... A63F 3/00

[52] U.S. Cl. ..... 273/240; 273/272

[58] Field of Search ..... 273/272, 240, 243

[56] References Cited

U.S. PATENT DOCUMENTS

| | | | |
|---|---|---|---|
| 2,175,591 | 10/1939 | Beneteau | 273/273 |
| 2,380,106 | 7/1945 | Hilton | 273/240 |
| 2,521,775 | 9/1950 | Brower | 273/273 |
| 2,876,012 | 3/1959 | Allen | 273/153 R |
| 3,179,414 | 4/1965 | Mertz | 273/240 |
| 3,394,471 | 7/1968 | Halten | 273/273 |
| 3,413,004 | 11/1968 | Smith | 273/269 |
| 3,618,231 | 11/1971 | Nason | 273/240 |
| 3,746,342 | 7/1973 | Fine | 273/272 |
| 4,071,245 | 1/1978 | Kendrick | 273/243 |
| 4,123,051 | 10/1978 | Tsacoyannis | 273/272 |
| 4,592,553 | 6/1986 | Mammen | 273/240 |

*Primary Examiner*—Edward M. Coven
*Assistant Examiner*—Benjamin Layno
*Attorney, Agent, or Firm*—Leon Gilden

[57] ABSTRACT

A method of playing a category game is set forth where a predetermined time is provided for each of a maximum of five players to associate a random category with a random pre-selected secret word wherein each category and secret word is chosen from a stack of various categories and secret words. A pre-selected category is inserted on an erasable board for a maximum of five categories and thereafter a single secret word comprising no more than five letters is written with a single letter written in each space of a five spaced line providing twenty-five spaces to be filled in by the players.

1 Claim, 2 Drawing Sheets

| 12 | H 17 | E 18 | A 19 | R 20 | T 21 |
|---|---|---|---|---|---|
| AUTOMOBILES | HENRY J | EDSEL | AUSTIN | RAMBLER | TUCKER |
| U.S. PRESIDENT 13 | HARRISON | EISENHOWER | ADAMS | ROOSEVELT | TRUMAN |
| U.S. CITIES 14 | HOUSTON | EL PASO | ATLANTA | RICHMOND | TAMPA |
| MAMMALS 15 | HYENA | ELAND | ANTELOPE | RAT | TIGER |
| GIRLS NAMES 16 | HEATHER | ELLEN | AMBER | REBECCA | TIFFANY |

METHOD OF PLAYING A CATEGORY GAME

BACKGROUND OF THE INVENTION

1. Field of the Invention

The present invention relates to educational games, and more particularly pertains to a new and improved educational category game wherein players must within predetermined time limits insert from memory a response to a certain category wherein the inserted response must begin with the overlying letter of a preselected "secret word".

2. Description of the Prior Art

Educational games and the like are well known in the prior art. As may be appreciated, these games are utilized for developing mental adroitness and providing amusement. In this connection, there have been several attempts educational games developed which may be utilized for similar purposes. For example, U.S. Pat. No. 2,175,591 to Benettau sets forth a geographical educational game wherein a plurality of cards bearing the name of a geographical entity are positioned within a recessed board to correspond to an enumerated geographical orientation of an enumerated indicia on a game board. While of conceptionally a word association game, the geographical game of Benettau is of a remote apparatus and method to that of the instant invention.

U.S. Pat. No. 2,521,775 to Brower sets forth a word game apparatus wherein a playing field is provided employing a plurality of stations distinct from each other and fewer number than playing pieces associated with the game. A cover element utilized overlying the stations is separate from the playing field providing an ability to dispense at any one time indicia of associated playing pieces whereby mental abilities of players utilizing the game are taxed to uncovered menemonic relations between the indicia of the playing field station and indicia of the playing pieces occupying the station wherein the cover element is adaptable to permit relative movement therebetween. The Brower patent is of a category generally more complex than that of the instant invention requiring elaborate instruction tending to discourage the use of the game as opposed to the instant invention with ease of use and adaptability to vary age groups encourages the educational effects of the instant invention.

U.S. Pat. No. 2,876,012 to Allen is set forth with a playing field provided with removable insertions thereon such that the matching of pre-provided portions to various players to the playing field effects the determination of a prize to be awarded to such player. The Allen game is remote from that of the instant invention lacking the educational and mental exercise that the instant invention requires.

U.S. Pat. No. 3,394,471 to Holten sets forth an educational game to match a definition of a foreign language to a U.S. translation to enhance the learning of a foreign language. It may be noted that the game of Holten is remote in organization and methodology to that of the instant invention.

U.S. Pat. No. 3,413,004 to Smith utilizes a plurality of rows and spaces wherein letters repeatedly occur in some rows. Game tiles are provided in groups to comprises a complete alphabet of letter tiles and a plurality of unlettered tiles wherein all tiles in a group being of the same color and each colored group corresponding to a different one of said designated row of colors. A plurality of transparent player tiles are provided to be placed over lettered spaces in the rows in response to selection and calling of lettered and colored tiles wherein each transparent tile provided thereon an opaque marking spaced a substantial distance from the center of the tile to provide a learning of spelling and reading and in differentiating between various parts of speech. The educational game of Smith may be noted is of a remote organization to that of the instant invention.

As such, it may be appreciated that there is a continuing need for a new and improved educational category game which addresses both the problem of ease of use and requirement of mental adroitness and in this respect, the present invention substantially fulfills this need.

SUMMARY OF THE INVENTION

In view of the foregoing disadvantages inherent in the known types of educational games now present in the prior art, the present invention provides an educational category game wherein the same provides a readily understandable yet effective means for improving mental proficiency and enhancing memory and word association ability of the user. As such, the general purpose of the present invention, which will be described subsequently in greater detail, is to provide a new and improved educational category game which has all the advantages of the prior art category games and none of the disadvantages.

To attain this, the present invention sets forth a method and means therefore that utilizes a timing mechanism to limit the game time and player time wherein an association of a categorical word to begin with an overlying letter in a column enhances memory and word association and utilizes plastic-coated cards easily erasable and reusable.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational category game which has all the advantages of the prior art educational category games and none of the disadvantages.

It is another object of the present invention to provide a new and improved educational category game which may be easily and efficiently manufactured and marketed.

It is a further object of the present invention to provide a new and improved educational category game which is of a durable and reliable construction.

An even further object of the present invention is to provide a new and improved educational category game which is susceptible of a low cost of manufacture with regard to both materials and labor, and which accordingly is then susceptible of low prices and sale to the consuming public, thereby making such educational category games economically available to the buying public.

Still yet another object of the present invention is to provide a new and improved educational category game which provides in the apparatuses and methods of the prior art some of the advantages thereof, while simultaneously overcoming some of the disadvantages normally associated therewith.

Still another object of the present invention is to provide a new and improved educational category game wherein word association of a particular category must begin with a letter of an overlying "secret word" with a time limit on such association by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
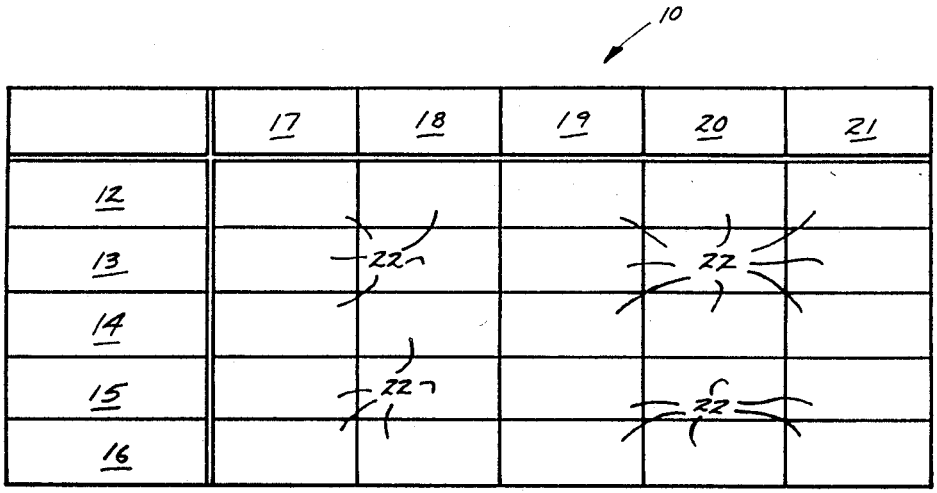
FIG. 1 is a top orthographic view of the game board as utilized by the instant invention prior to inscription.
FIG. 2 is a top orthographic view of the game board as utilized by the instant invention illustrating an example of a typical game completing the board.

With reference now to the drawings, and in particular to FIGS. 1 and 2 thereof, a new and improved educational category game embodying the principles and concepts of the present invention and generally designated by the reference numeral 10 will be described.

More specifically, it will be noted that the educational category game essentially comprises a playing board 10 defining a plurality of spaces thereon. Five vertical column spaces, including first vertical column space 12, second vertical column space 13, third vertical column space 14, fourth vertical column space 15 and a sixth rectangular space defining a fifth vertical column space 16. The vertical column spaces enable the writing in of the various categories to be discussed in more detail below, as illustrated in FIG. 2.

Figure 3:
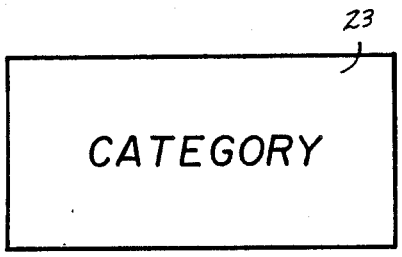
FIG. 3 is a top orthographic view of a typical category card, as utilized by the instant invention.
Figure 4:
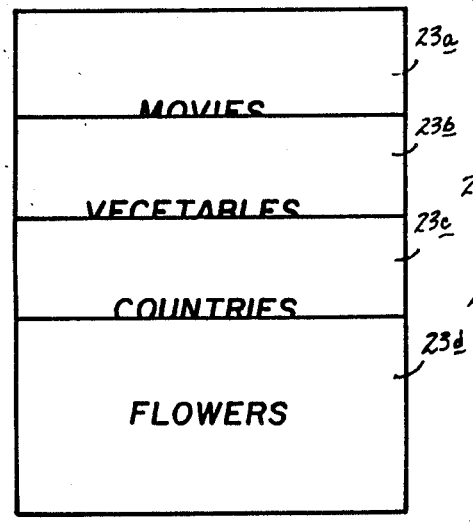
FIG. 4 is an orthographic view of an array of category cards utilizing examples of typical categories stacked in an offset array.

The first, second, third, fourth, and fifth respective horizontal row spaces 17, 18, 19, 20, and 21 are aligned, as illustrated in FIGS. 1 and 2 at the uppermost top portion of the playing board 10 for accepting of respective letters of a "secret word" to be discussed in more detail below. FIGS. 3 and 4 illustrate the "category" cards to be utilized in association with the instant invention. Specifically each category card has the term "category" imprinted on a first side thereon, as illustrated in FIG. 3, wherein the second side of each category card has printed thereon various categories, as illustrated in FIG. 4, where the staggered array of category cards of FIG. 4 is illustrated offset from one another to enable a game participant to select an uppermost card, such as that imprinted with the word "movies" on the second side 23*a*. Further cards have included or imprinted thereon various categories, such as vegetables, countries and flowers, on their respective second sides 23*b*, 23*c*, and 23*d*.

Figure 6:
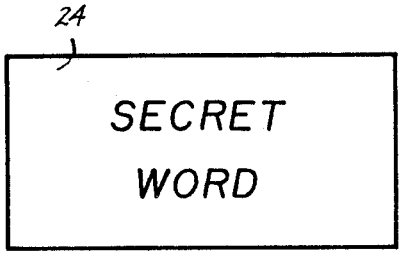
FIG. 6 is a top orthographic view of a typical "secret word" card, as utilized by the instant invention.
Figure 7:
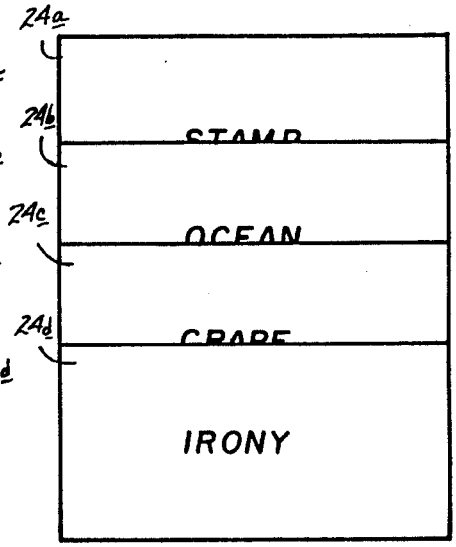
FIG. 7 is an orthographic view of the "secret word" cards in an offset array, as utilized by the instant invention.

FIGS. 6 and 7 are illustrative of the "secret word" cards. As in the stacking of the category cards illustrated in FIG. 4, the "secret word" cards are also stacked in a staggered array, as illustrated in FIG. 7, wherein various five-lettered word "secret words", such as "stamp", "ocean", "grape", and "irony", are imprinted on each respective side 24*a*, 24*b*, 24*c*, and 24*d*.

Figure 5:
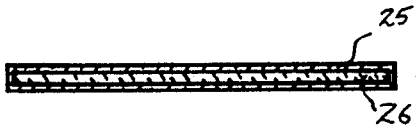
FIG. 5 is a cross-sectional view of the instruction of the cards and game board, as utilized by the instant invention.

The playing board 10 and the various "category" and "secret word" cards are formed, as illustrated in FIG. 5, with an encapsulating plastic-like covering 25 surrounding a paste-board like core 26. The covering 25 protects the imprinting of the various terms imprinted on the "category" of "secret word" cards, as well as the diagrammatic configuration of the playing board defining the various vertical column spaces and horizontal row spaces.

Figure 8:
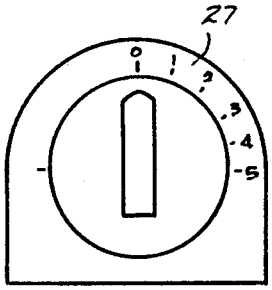
FIG. 8 is an orthographic view taken in elevation of a timer, as utilized by the instant invention.

FIG. 8 is an illustration of a typical timer device 27, as utilized with the instant invention providing five minutes of timing in which to play the game.

Reference is now made to FIGS. 1 to 8 which depict the manner in which the game apparatus is utilized.

Initially, all of the respective "category" cards and "secret word" cards are stacked in respective arrays with the first side 23 of the "category" cards and the first side 24 of the "secret word" cards oriented for visual observation by the players. A maximum of five players may participate in playing the game wherein should a sixth or greater number of players participate, a sixth player may serve the roll of time keeper and selector of a "secret word" to be utilized in conjunction with the game. The time of each game is five minutes and the game thereby may be played on a rotational basis should more than five players wish to participate.

Assuming five players are participating, each player selects a "category", such as automobiles, in first vertical column space 12 etc., to set forth the exemplary "categories" positioned within the first through fifth vertical column spaces 12 through 16 respectively. Should a player not be able to provide a "category", such as automobiles or U.S. Presidents for example by the player's own recall, then a "category" card may be selected to provide a suitable category, but that player is penalized five points in requiring the assistance of the GAME "category" card. It is contemplated that a total of twenty-five "category" cards be available for the supplying or rotational basis a prospective series of five games wherein potentially each of the five players may require use of a "category" card.

A "secret word" is then selected by a designated player wherein each "secret word" is formed of no more or less than five letters, such as the example "heart" in FIG. 2. Each letter of the word is then written within each respective horizontal row space 17 through 21.

The timer 27 is then set to five minutes and the commences wherein each player is provided with an individual playing board 10 and proceeds to fill in each of the game spaces 22 under the following guidelines. Under the "category" of automobiles within the first vertical column space 12, the name of the particular automobile must begin with the letter "H" and accordingly "Henry J." is selected as an example in the intersection of vertical column space 12 and horizontal row space 17. In a like manner, each of the game spaces 22 is filled in with a response that must satisfy the "category" and begin with the letter overlying the game space 22 designated by the "secret word". In this manner it is noted that all of the responses under the letter "H" begin with an "H", the responses under the letter "E" begin with an "E" from the horizontal row space, etc.

At the end of the pre-designated five minute time interval, the game is halted and scoring is then calculated.

Scoring is as follows: Five points is provided for a designated selection that properly responds, but four points is awarded if two players made the same selection, three points if three players make the same selection, two points if four players make the same selection, and finally one point if five make the same selection. There are no points awarded for a blank space and accordingly the highest point total designates the winner of the game.

As noted earlier, five points is deducted for each player that requires the assistance of a "category" card. If less than five players participate, then the points rule can be adjusted, such as three players will each be awarded five points for providing an original selection, wherein three points would be awarded if two players provide the same selection or response and one point if all three players have the same selection, thereby assuring that only one point is awarded if all players make the same selection within a game space 22.

The manner of usage and operation of the present invention therefore should be apparent from the above description and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A method of playing an educational category game comprising;

providing a plurality of playing boards corresponding to a predetermined number of players wherein each playing board has formed thereon a matrix of orthogonally equally spaced intersecting lines defining a plurality of vertical column spaces along the left side edge of a playing surface of the playing board corresponding to the predetermined number of players, and each of said boards further including providing a plurality of horizontal row spaces along a top horizontal edge with a playing surface of the playing board, and wherein a submatrix of game spaces are defined by forming the intersecting lines on the playing surface in alignment with respective column spaces and respective row spaces, and further providing a plurality of "category" cards imprinted with the term "category" on a first side of the "category" card and terminology on a second side of said "category" card to define a "category" of knowledge, and providing a plurality of "secret word" cards imprinted with the term "secret word" on a first side of each of said "secret word" cards, and imprinted on the second side of each "secret word" card a word having a predetermined number of letters equal to the number of said horizontal row spaces along each horizontal top edge of said playing boards further including the step of directing each player to provide a "category", but should each player be unable to do so, directing said player to select a "category" card with a five point penalty as a consequence, and further including the step of awarding each player five points upon providing an appropriate "response word", each player writing down the catagories on the vertical column spaces along each left side of their playing board, and a designated player selecting a "secret word" card, each player writing down each letter, of the word on the selected "secret word" card, within each respective said horizontal row space of their playing board, and directing each of two players to receive four points upon a duplication of a "response word" among the two players, and further directing each of three players to receive three points upon duplication of a "response word" among the three players, and finally directing each of four players to receive two points upon duplication of a "response word" among the four players.

* * * * *